United States Patent [19]

Gutierrez, Jr.

[11] 4,233,864

[45] Nov. 18, 1980

[54] UPPER MAIN BEARING REMOVAL TOOL

[76] Inventor: Abel Gutierrez, Jr., 169 Dolores St., Oswego, Ill. 60543

[21] Appl. No.: 950,989

[22] Filed: Oct. 13, 1978

Related U.S. Application Data

[63] Continuation of Ser. No. 776,310, Mar. 10, 1977, abandoned.

[51] Int. Cl.[3] ..... B25B 27/14

[52] U.S. Cl. ..... 81/3 R; 29/275

[58] Field of Search ..... 29/267, 275; 81/3 R; 254/21, 25

[56] References Cited

U.S. PATENT DOCUMENTS 1,344,619 6/1920 Colvin ..... 29/267

3,406,412 10/1968 Kottas ..... 81/3 R X

*Primary Examiner*—James G. Smith

*Attorney, Agent, or Firm*—Neuman, Williams, Anderson & Olson

[57] ABSTRACT

An upper main bearing removal tool is provided which includes an elongated handle section joined at one end to one end of an arcuate blade section, the free end of the blade section being flat for engagement with an edge of a main bearing with the free end of the handle section being flat for engagement by an impact tool. The arcuate length of the blade section is aproximately 135 degrees and the handle section has an axis in a plane intersecting the arcuate blade section in a region approximately midway between the ends thereof.

11 Claims, 6 Drawing Figures

UPPER MAIN BEARING REMOVAL TOOL

This application is a continuing application with respect to, my prior copending application, Ser. No. 776,310, filed Mar. 10, 1977, now abandoned.

BACKGROUND OF THE INVENTION

This invention relates to an upper main bearing removal tool and more particularly to a tool which is readily operable by one person to effect rapid removal of a main bearing without damage thereto. The tool is rugged and durable and has a relatively simple design and can be economically manufactured.

The present invention relates to bearing removal tools and is more particularly concerned with a tool for the removal of upper main bearings.

As is well known, internal combustion engines transmit the power generated by means of a crankshaft which is rotatably supported within a series of bearings designated as the main bearings of the engine. Such main bearings are generally horizontally split, the upper portion constituting the upper shell and the lower portion being referred to as the lower shell. The lower bearing shell is maintained in place by means of a bearing cap which is secured to stud members in the engine block. The bearing cap and lower shell is usually easily removable; however, the upper main bearing or upper shell is removable with greater difficulty. Frequently a bearing removal tool is employed which is inserted in the oil hole of the crankshaft. The Rookstool U.S. Pat. No. 2,639,498 discloses one such type of tool. With such a tool, the crankshaft must be rotated and these prior procedures often required the presence of more than one person. Further, the rear main bearing is customarily not provided with an oil hold thereby necessitating a time-consuming and laborious bearing removal procedure.

In order to avoid resort to the procedures which employed the crankshaft oil holes, partially because of the need for more than one person during the bearing removal, various other tools were developed. U.S. Pat. No. 3,886,644 issued June 3, 1975 to General Motors Corporation, for example, discloses a tool which is mountable on the engine block and employs a pawl and ratchet arrangement in the urging of the upper shell from the engine. Such a device, however, is complex in structure and, therefore, relatively expensive.

The Coleman U.S. Pat. No. 2,800,708, issued July 30, 1957 discloses a tool for removing bearings which is in the form of an elongated resilient metal strip having a transverse curvature over substantially its entire length within a straight position, the resilient metal strip being bendable to enter the space between the outer surface of a crankshaft and the inner surface of an engine block. With such a tool there would be difficulties in transmitting impact forces of sufficient magnitude, due to the flexibility of the metal strip. It would also be difficult to avoid damage to the bearing surfaces.

Tools designed for other purposes, such as the pick of the Kottas U.S. Pat. No. 3,406,412 and the drift bar of the Colvin U.S. Pat. No. 1,344,619, are not at all suitable for use in removal of an upper main bearing.

SUMMARY OF THE INVENTION

It is one object of the invention to provide an upper main bearing removal tool which is of simple construction and can be employed by a single person in the removal of the upper main bearing.

It is another object of the invention to provide an upper main bearing removal tool which is inexpensive and is easily manipulated by a single person in the removal of the upper main bearing.

In accordance with this invention, a tool is provided which includes a straight elongated handle section and an arcuate blade section integrally secured at one end to one end of the handle section, the blade section extending to an opposite free end having a flat face for engagement with an edge of an upper main bearing while the handle section extends to an opposite end having a flat face for engagement by a hammer or other impact tool. The blade section has an arcuate length of between 90 and 180 degrees and it is substantially rigid but relatively thin, permitting it to be inserted between the external cylindrical surface of a crankshaft and the internal cylindrical surface of an engine block and to permit movement of the main bearing through an angle of at least on the order of 90 degrees after which the main bearing may be pulled to a completely freed position.

Important features relate to the relationship between the blade and handle sections such as to permit efficient application of the impact forces. The handle section has an axis which lies in a first plane transverse to the axis of the arcuate blade section and in a second plane which is transverse to the first plane and which intersects the blade section between the ends thereof. Preferably, the second plane intersects the blade section in a region approximately midway between the ends of the blade section.

The blade section most preferably has an arcuate length of approximately 135 degrees and it preferably has a uniform thickness which is slightly less than that of the upper main bearing to be removed which is a small fraction of the radius of the inner main bearing surface.

Another feature is that at least the opposite free end of the blade section is of a soft metal having a softness of approximately that of brass, to minimize the possibility of damage to bearing surfaces.

Another feature is that the blade section increases in its transverse dimension, parallel to the axis of curvature thereof, from its one end joined to the handle section to its opposite free end. Thus the flat face at the opposite free end may be of greater area to minimize the unit pressure applied to the main bearing when impact forces are applied.

This invention contemplates other features, objects and advantages which will become more fully apparent from the following detailed description taken in conjunction with the accompanying drawings.

DESCRIPTION OF A PREFERRED EMBODIMENT

Figure 1:
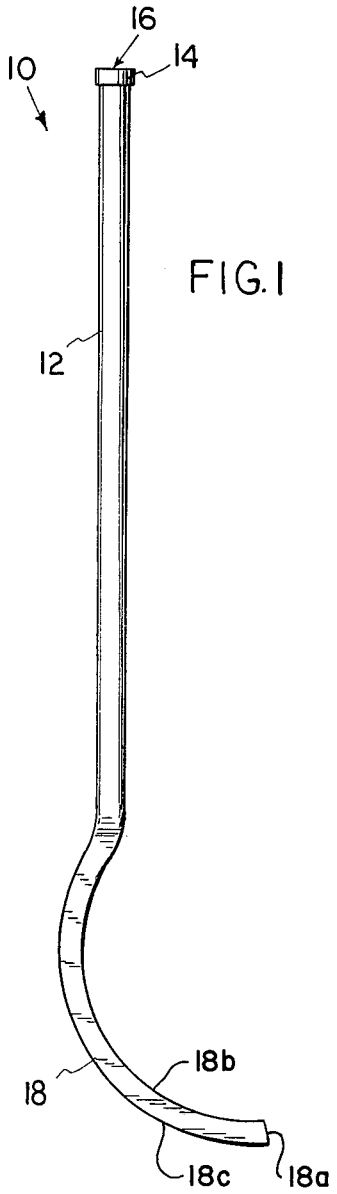
FIG. 1 is a side elevational view of the upper main bearing removal tool of the invention.
Figure 2:
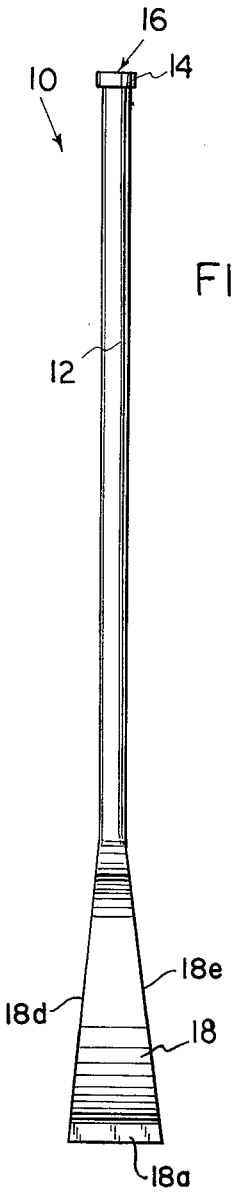
FIG. 2 is a front view of the tool shown in FIG. 1.
Figure 3:
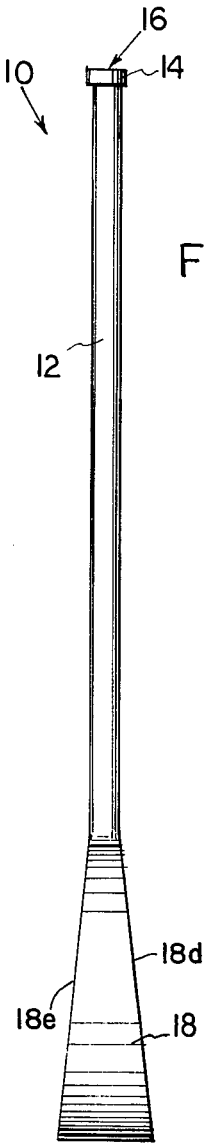
FIG. 3 is a rear view of the tool shown in FIG. 1.

Reference numeral 10 generally designates an upper main bearing removal tool constructed in accordance with the principles of this invention and comprising an elongated handle section 12 which may desirably be formed of steel and which is dimensioned so as to be substantially rigid when in use. The handle section may be cylindrical in cross-section with a diameter in the range of from 5/16 to ⅜ inches.

Figure 6:
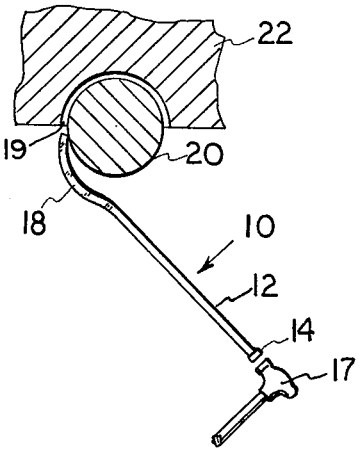
FIG. 6 is a cross-sectional end view of an engine block and crankshaft showing an upper main bearing in position and the manner of applying the bearing removal tool of the invention thereto.
Figure 4:
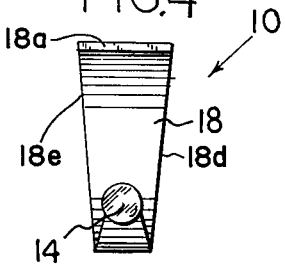
FIGS. 4 and 5 are top and bottom plan views respectively of the bearing removal tool shown in FIG. 1.
Figure 5:
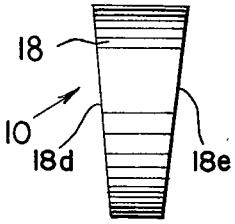

The handle section 12 has an enlargement or butt 14 at a free end which has a flat end surface 16 adapted to receive impacts or blows from a suitable impact tool such as a ball peen hammer 17, as indicated in FIG. 6.

One end of the handle section 12 is integrally joined to one end of an arcuate blade section 18 which as is shown in the drawings has a planar or flat face 18*a* for engagement with one edge of an upper main bearing 19, as shown in FIG. 6. As shown, the bearing 19 may be disclosed between the outer cylindrical surface of a crankshaft journal 20 and the inner cylindrical surface of an engine block 22. The tool may be positioned as shown in FIG. 6 with tapping forces being applied from the hammer 17 to the surface 16 and being transmitted through the tool to the bearing 19 which is rotated about its axis through an angle of about 90 degrees, exposing approximately half of the main bearing 19 which can then be pulled out to a fully freed position.

The arcuate length of the blade section 18 should be between 90 and 180 degrees and is preferably approximately 135 degrees as is illustrated in the drawings.

An important feature relates to the relationship between the handle section 12 and the blade section 18. In the construction as illustrated, the axis of the elongated handle section 12 is in a first plane which is transverse to the axis of the arcuate blade section and the axis of the handle section 12 is also a second plane which intersects the blade section 18 between its opposite ends, the second plane preferably intersecting the blade section 18 at a region about midway between its opposite ends, as is the case with the tool as illustrated in the drawings. With this relationship, optimum transmission of the impact forces is obtained and the required movements of the tool to obtain removal of the main bearing is facilitated.

As is also illustrated, the blade section 18 has a uniform thickness, with inner and outer coaxial cylindrical surfaces 18*b* and 18*c*. The difference between the radii of the surfaces 18*b* and 18*c*, i.e. the thickness of the blade section 18, is slightly less than the thickness of the main bearing to be removed.

As is also shown in the drawings, the blade section 18 increases in its transverse dimension, parallel to its axis, from the end thereof joined to the handle section 12 to the free end which has the flat surface 18*a*. Thus side edge surfaces 18*d* and 18*e* are provided and it is noted that as shown, the surfaces 18*d* and 18*e* diverge at equal angles with respect to a plane through the axis of the handle section 12 and transverse to the axis of the blade section 18.

In order to avoid scratching or otherwise marring the journal surfaces of the crankshaft or block during removal of the upper shell, the blade section 18 is desirably clad with one of the soft metals such as brass or is formed totally thereof. The arcuate length of the blade section is preferably approximately one-third of the length of the handle section as is shown. Suitable lengths for the handle section 12 are within the range of from 10 to 10.25 inches and a suitable length for the blade section is 3.75 inches. The thickness of the blade section should desirably be less than that of the handle section and within the range of from 3/32 to ⅛ inch. A preferred thickness for the blade section is within the range of from 0.110 to 0.120 inches. A radius of curvature for the blade section is desirably at least 2 inches and a preferred radius is 2.25 inches, it being noted that the thickness of the blade section is a small fraction of its radius, on the order of 1/16 or less.

It will be observed that due to the arrangement of the straight handle and integrally united arcuate blade section with its gradually increasing width, a succession of relatively light tapping forces on the butt end of the handle results in an effective journal driving force on the upper bearing shell. The blade section easily extends about the crankshaft journal during the removal procedure without jamming or damage to any of the bearing or journal surfaces.

It will be understood that modifications and variations may be effected without departing from the spirit and scope of the novel concepts of this invention.

I claim as my invention:

1. A tool for removal of an upper main bearing of an engine from a position between an external cylindrical crankshaft surface and an internal semi-cylindrical engine block surface, comprising: a straight elongated handle section and an arcuate blade section integrally secured at one end to one end of said handle section, said blade section extending from said one end thereof to an opposite free end having a flat face for engagement with one end of said upper main bearing, said handle section extending from said one end thereof to an opposite free end having a flat face for application of tapping forces by an impact tool, said flat face of said free end of said blade section being engageable with one edge of said upper main bearing while tapping forces are applied to said flat face of said free end of said handle section with the tapping forces being transmitted through said tool to said main bearing, said blade section being substantially rigid but relatively thin and having an arcuate length of between 90 and 180 degrees, short enough for effective transmission to said main bearing of impact forces applied from said handle section but long enough for effecting removal of the major portion of said main bearing from said position.

2. In a tool as defined in claim 1, said blade section being arcuate about a certain axis, said straight elongated handle section having an axis in a first plane transverse to said axis of said arcuate blade section and in a second plane transverse to said first plane and intersecting said blade section between said one end thereof and said opposite free end thereof.

3. In a tool as defined in claim 2, said second plane intersecting said arcuate blade section in a region approximately midway between said one end of said blade section and said opposite free end thereof.

4. In a tool as defined in claim 1, said blade section having an arcuate length of approximately 135 degrees.

5. In a tool as defined in claim 1, said arcuate blade section having inner and outer cylindrical surfaces on a common axis with the difference between the radii of said inner and outer cylindrical surfaces being slightly less than the difference between the radii of said external cylindrical crankshaft and internal engine block surfaces, the thickness of said blade section being thereby substantially uniform and less than that of said upper main bearing and also being a small fraction of the radius of the inner main bearing surface.

6. In a tool as defined in claim 1, at least said opposite free end of said blade section being of a soft metal and having a softness of approximately that of brass.

7. In a tool as defined in claim 1, the arcuate length of said blade section being approximately one-third the length of said handle section.

8. In a tool as defined in claim 1, said blade section increasing in transverse dimension from said one end thereof to said opposite free end thereof.

9. In a tool as defined in claim 3, said blade section having an arcuate length of approximately 135 degrees, said arcuate blade section having inner and outer cylindrical surfaces on a common axis with the difference between the radii of said inner and outer cylindrical surfaces being slightly less than the difference between the radii of said external cylindrical crankshaft and internal engine block surfaces, the thickness of said blade section being thereby substantially uniform and less than that of said upper main bearing and also being a small fraction of said inner cylindrical surface of said arcuate blade section.

10. A device comprising: a straight elongated section and an arcuate section integrally secured at one end to one end of said straight elongated section, said arcuate section extending from said one end thereof to an opposite free end having a flat face, said straight elongated section extending from one end thereof to an opposite free end having a flat face, said arcuate section being substantially rigid but relatively thin and having an arcuate length of approximately 135 degrees, said arcuate section having inner and outer frusto-cylindrical surfaces on a common axis with the difference between the radii of said inner and outer frusto-cylindrical surfaces being a small fraction of the radius of said inner and outer frusto-cylindrical surfaces on the order of 1/16 or less, and said straight elongated section having an axis in a first plane transverse to said common axis of said inner and outer frusto-cylindrical surfaces and in a second plane transverse to said first plane and intersecting said arcuate section in a region approximately midway between said one end of said arcuate section and said opposite free end thereof.

11. In a device as defined in claim 10, said straight elongated section having a length of on the order of 10 inches, said arcuate section having a length of on the order of 3.75 inches, said arcuate section having a thickness of on the order of from 3/32 to $\frac{1}{8}$ inch, and said arcuate section having a radius of on the order of 2.25 inches, said staight elongated and arcuate sections being of steel and said opposite free end of said arcuate section being of a soft metal having a softness of approximately that of brass.

* * * * *